United States Patent [19]

Riley et al.

[11] Patent Number: 4,779,532

[45] Date of Patent: Oct. 25, 1988

[54] INTEGRATED FILTERED AND SHIELDED IGNITION ASSEMBLY

[75] Inventors: Leon H. Riley; Gerald S. Smith, both of Huntsville, Ala.

[73] Assignee: The United States of America as represented by the Secretary of the Army, Washington, D.C.

[21] Appl. No.: 115,497

[22] Filed: Oct. 23, 1987

[51] Int. Cl.[4] ..... F42C 19/12

[52] U.S. Cl. ..... 102/202.2

[58] Field of Search ..... 102/202, 202.2, 202.5, 102/202.9, 202.14, 380

[56] References Cited

U.S. PATENT DOCUMENTS

| | | | |
|---|---|---|---|
| 2,462,135 | 2/1949 | Skinner | 102/202 |
| 2,918,001 | 12/1959 | Alford | 102/28 |
| 3,018,733 | 1/1962 | Johnson | 102/70.2 |
| 3,094,932 | 6/1963 | Greenlees | 102/28 |
| 3,343,491 | 9/1967 | Peters, Jr. | 102/70.2 |
| 3,421,440 | 1/1969 | Snyder | 102/70.2 |
| 3,572,247 | 3/1971 | Warshall | 102/202.2 |
| 3,640,224 | 2/1972 | Petrick et al. | 102/28 |
| 3,793,954 | 2/1974 | Johnston | 102/28 R |
| 4,271,453 | 6/1981 | Yajima et al. | 102/202.2 |
| 4,592,280 | 6/1986 | Shores | 102/202.2 |

FOREIGN PATENT DOCUMENTS

| | | | |
|---|---|---|---|
| 3204279 | 8/1983 | Fed. Rep. of Germany | 102/202.2 |

*Primary Examiner*—Charles T. Jordan

*Attorney, Agent, or Firm*—Freddie M. Bush; James T. Deaton; Hay Kyung Chang

[57] ABSTRACT

An integrated filter and shielded ignition assembly locates all ignitable materials inside of the sealed metallic enclosure. The sealed metallic enclosure is present to prevent electromagnetic radiation interference and thereby enables the enclosure to have only one path where electricity can flow. The filter is considered a low bandpass electric filter. The filter does not interfere with the ordinary electric function of the ignition assembly.

2 Claims, 2 Drawing Sheets

INTEGRATED FILTERED AND SHIELDED IGNITION ASSEMBLY

The invention disclosed herein may be manufactured, used and licensed by or for the Government for governmental purpose without the payment to me of any royalties thereon.

BACKGROUND OF THE INVENTION

Currently, rocket motor ignition assemblies do not provide for eletromagnetic radiation (EMR) protection. EMR hardening is accomplished by providing filtering and shielding of the initiator leads of the missile system level and external to the ignition assembly. This established process requires extensive address of the EMR hardening to be included in the design of each missile. The cost of the current process is expensive.

SUMMARY OF THE INVENTION

The integrated filters and shielded ignition assembly for rocket motors provides for the placing of one or more low bandpass electric filters in series with the electric leads that function the assembly. The ignition assembly locates all ignitable materials inside a sealed metallic enclosure such that the only electric path into the enclosure is through the filter. The enclosure and filter limit the level of EMR induced currents that can enter the enclosure. The filter does not degrade the normal electric functioning of the ignition assembly.

DESCRIPTION OF THE PREFERRED EMBODIMENT

Figure 1:
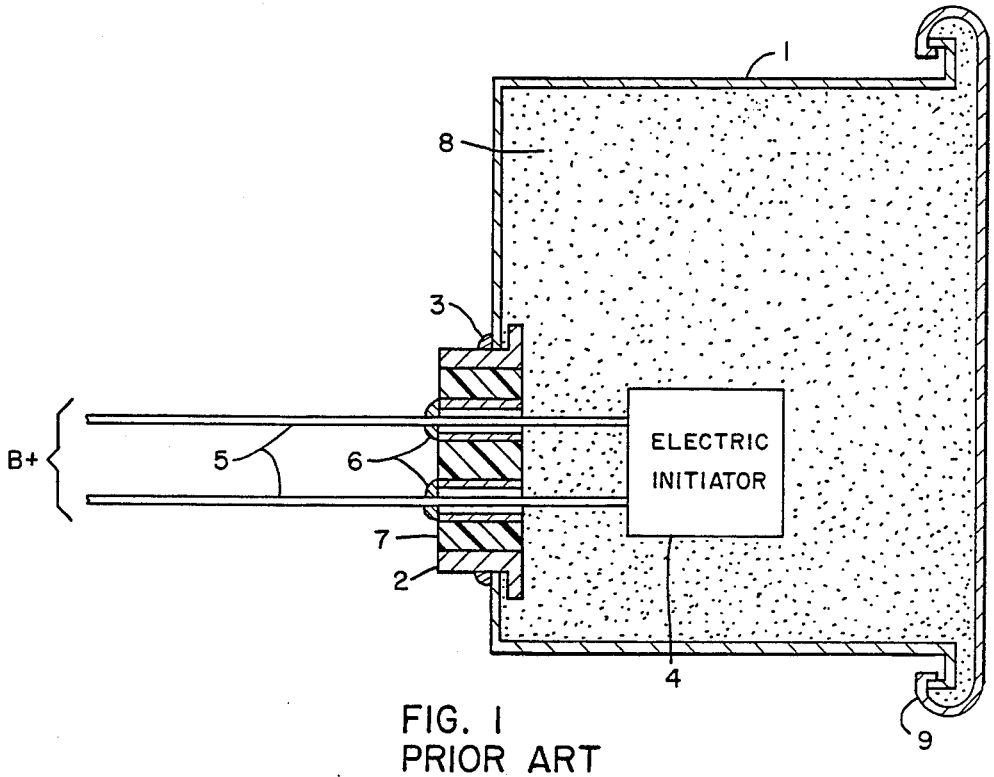
FIG. 1 PRIOR ART
FIG. 1 is a sectional diagram of a prior art rocket motor ignition assembly.
Figure 2:
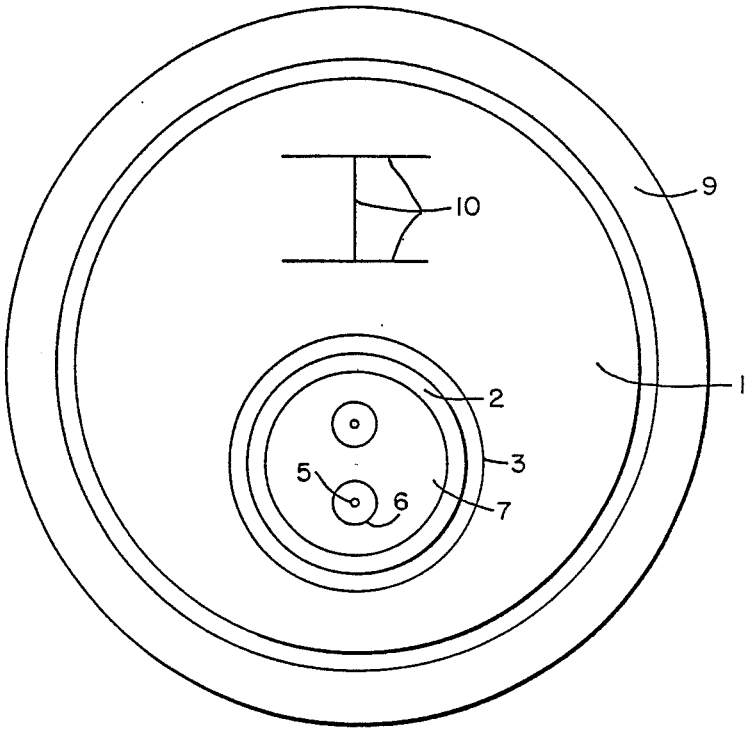
FIG. 2 PRIOR ART
FIG. 2 is a rear view diagram of a prior art rocket motor ignition assembly.

Referring now to the drawings wherein like numbers refer to like parts in all of the Figures, an example of a typical type of rocket motor ignition assembly is shown in FIGS. 1 and 2. A metal cup 1 has a feed-through 2 for electric initiator leads 5. Feed-through 2 is soldered 3 into the bottom of cup 1. An electric initiator 4 is located within cup 1 and leads 5 are soldered 6 into the feed-through 2. Leads 5 are bare wires (not insulated) at the point of entry into feed-through 2. Electric insulation 7 forms a part of and seals the base of the feed-through 2 and at the same time allows electric current to flow into the electric initiator 4 since the insulation prevents solder from short-circuiting the wires. Black powder 8 or other ignition materials are placed into the cup 1 and the cup 1 is sealed with a metal disk closure 9. The assembly is functioned by application of a designated level of electric voltage B+ and current to the initiator leads 5. As shown in FIG. 2, a crease 10 in the metal cup 1 provides a weakened area in the structure and serves as a preferred rupture area for ignition gases. Operation of nearby radios or radars may provide electromagnetic radiated fields that induce voltages and currents into the leads and cause inadvertant function of the assembly.

The integrated filtered and shielded ignition assembly provides for the replacement of the electric feed-through 2 with a low bandpass electric filter that allows direct current (DC) intended ignition energies to function the electric initiator 4, but does not allow passage of EMR into the assembly. In addition to the filtering it is also necessary to provide for mounting the filter such that the electromagnetic radiation does not leak into the assembly and come into contact with the electric initiator 4 and black powder 8. Also, it is necessary to make an electromagnetic tight seal at the metal disk closure 9 to cup 1 interface in order to prevent leakage.

Figure 3:
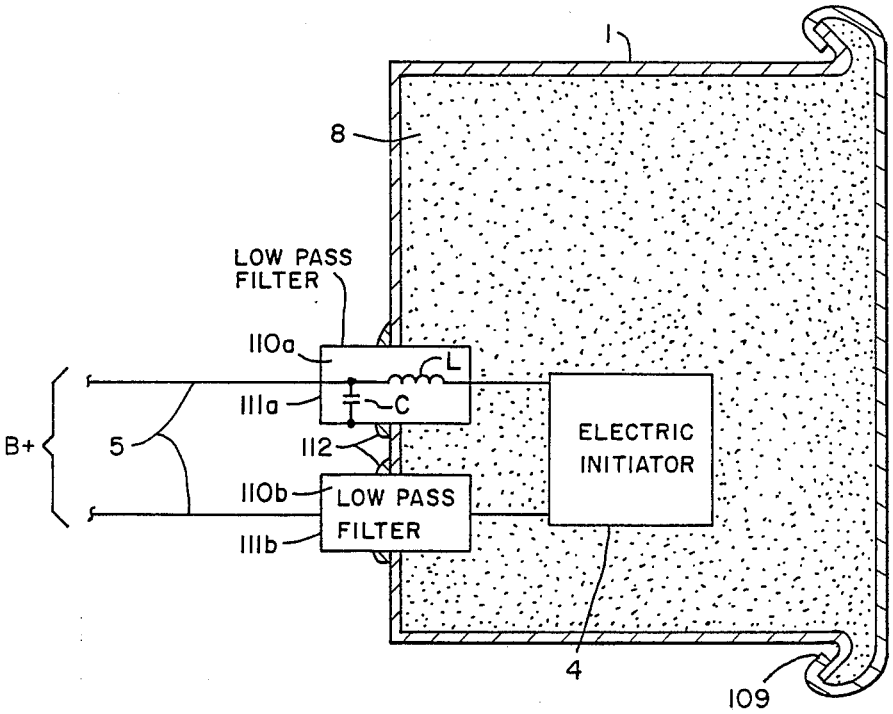
FIG. 3 is a sectional diagram of a two filter embodiment of an integrated filter and shielded electric ignition assembly for rocket motors.

FIG. 3 shows a two filter version of an integrated filter and shielded ignition assembly. In constructing the assembly, the filters 110*a* and 110*b* with input leads 5 are installed in an electromagnetic radiation leak proof housing 111. This housing is soldered 112 or screwed to housing cup 1. The electric initiator 4 and the black powder 8 or other ignition materials are added. Next, the assembly is closed so that no electromagnetic radiation or electromagnetic radiation induced currents can leak into the interior of the assembly by proper installation of the metal disk closure crimp seal 109. The metal disk closure crimp seal should be composed of an electrically conductive material, therefore there will be metal to metal contact. The seal 109 is leak proof all around. Any electromagnetic radiation induced currents are limited by the particular types of filters 110*a* and 110*b*, the material used in the cup, the disk material, the thickness of those materials, the method of filter installation, and the method of disk-to-cup closure. These currents can normally be limited to an acceptable level to support EMR hardness requirements. For example, a low bandpass filters 110*a* and 110*b* can consist of an inductor L in series with the respective electric initiator leads 5 and a capacitor C acting as a shunt to the housing which is coupled to system ground. The capacitors prevents EMR from entering the system. By providing a low impedance path to ground for radio frequency currents without effecting the direct current to the ignitor.

Figure 4:
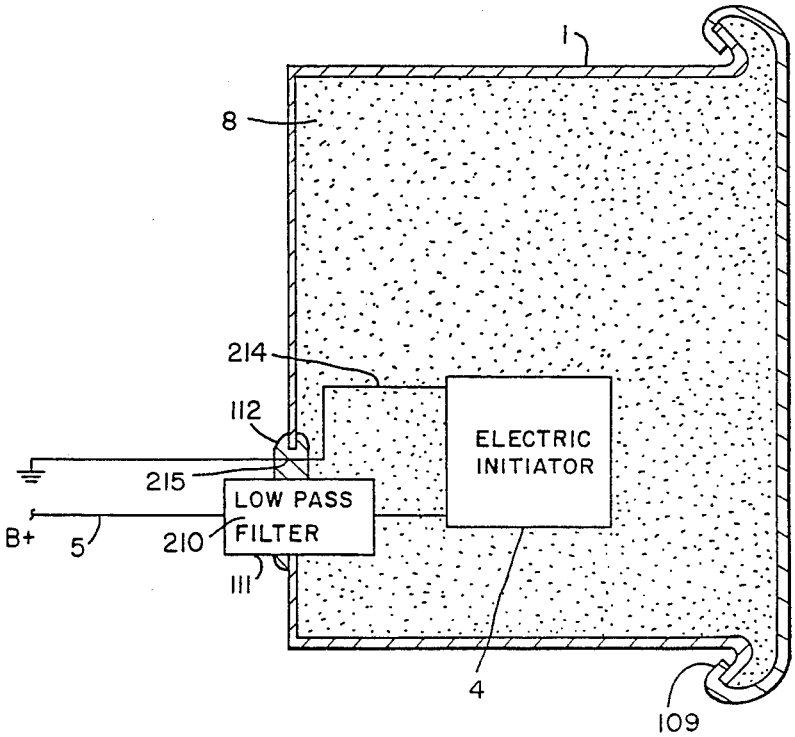
FIG. 4 is a sectional diagram of a single filter embodiment of an integrated filter and shielded electric ignition assembly for rocket motors.

FIG. 4 shows a single filter version of an integrated filter and shielded ignition assembly. There is little difference between the single filter embodiment and the two filter embodiment. In construction of the assembly, the filter 210 with a single initiator electric lead 5 are installed in an electromagnetic radiation leak proof housing 111. The filter 210 is connected to the electric initiator 4 by way of the lead 5. The return path from the electric initiator 4 is a return lead 214 that is also grounded and sealed at terminal 215 to the metal cup by an electrical connection. In operation, the electric initiator lead 5 is functioned by applying the voltage B+ through the filter 210 to the initiator 4 and then to the metal cup 1 at the electrical connection 215 to complete the circuit.

We claim:

1. A shielded ignition assembly for explosive materials comprising: a metal cup, explosive materials within said metal cup, an electrical initiator embedded in said explosive materials, said cup having first and second openings in the bottom thereof and an open end opposite said bottom, a metal closure sealably covering said open end, first and second metal housings disposed in respective of said first and second openings in the bottom of said cup means for sealably attaching said housings to the bottom of said cup, first and second filters disposed in respective of said first and second metal housings, said filters having respective input and output conductors for selectively passing and preventing electrical frequency signals through the housings, said output conductors of said first and second filters being connected to said initiator within said cup, whereby said initiator and said explosive materials are shielded from unintended electrical frequency signals, said means for sealably attaching is conductive metal sealant between said cup and said housings thus providing a continuous electrical conducting path throughout said cup and between said cup and said housings, and said filters are low pass filters for preventing frequency electromagnetic radiation from passing into the cup.

2. A system that prevents high frequency electromagnetic radiation from entering a closed container comprising: a metal cup, explosive materials within said metal cup, an electrical initiator embedded in said explosive materials, said cup further having a single opening in the bottom thereof and an open end opposite said bottom, a metal closure sealably covering said open end, a metal housing disposed in the single opening of said cup, means for sealably attaching said housing to the bottom of said cup, a filter disposed in said single metal housing, said filter having respective input conductor and output conductor for passing selected electrical signals through the housing, said output conductor of said filter being connected to said initiator within said cup whereby said initiator and said explosive materials are shielded from unintended electrical frequency signals by said cup, housing and filter, a ground lead coupled within said cup to the cup bottom for completing an electrical path for incoming signals on said filter, and wherein said means for sealably attaching is conductive metal sealant between said cup and said housing thus providing a continuous electrical conductivity throughout said cup and housing, and wherein said filter is a low pass filter, and further comprising a ground connection external of said cup and coupled to said cup for providing a complete electrical circuit path for incoming electrical signals.

* * * * *